US006112748A

United States Patent [19]

Esdale et al.

[11] Patent Number: 6,112,748

[45] **Date of Patent: *Sep. 5, 2000**

[54] METHOD FOR FACILITATING BREAST FEEDING OF A BABY UTILIZING A NURSING TABLE

[76] Inventors: Steven J. Esdale; Lisa B. Esdale, both of 960 SW. 135th Way, Davie, Fla. 33325

[ * ] Notice: This patent issued on a continued prosecution application filed under 37 CFR 1.53(d), and is subject to the twenty year patent term provisions of 35 U.S.C. 154(a)(2).

[21] Appl. No.: 08/846,918

[22] Filed: Apr. 30, 1997

Related U.S. Application Data

[60] Provisional application No. 60/016,915, May 6, 1996, abandoned.

[51] Int. Cl.[7] ..... A61B 19/00

[52] U.S. Cl. ..... 128/898

[58] Field of Search ..... 108/43, 49, 116, 108/127, 131, 129, 130, 132, 133; 248/188.5, 188.6, 188.8, 188.91; 128/898; 297/153, 135, 174, 182, 219.1, 464

[56] References Cited

U.S. PATENT DOCUMENTS

| | | | |
|---|---|---|---|
| 2,556,261 | 6/1951 | Dubach | 108/129 |
| 2,954,635 | 10/1960 | Stotter | 108/90 |
| 3,123,935 | 3/1964 | Williams | 108/43 |
| 3,855,946 | 12/1974 | Bales | 248/188.5 |
| 5,284,100 | 2/1994 | Thorn | 108/129 |

FOREIGN PATENT DOCUMENTS

| | | | |
|---|---|---|---|
| 88234 | 1/1937 | Switzerland | 108/133 |

*Primary Examiner*—Mickey Yu
*Assistant Examiner*—Kelly O'Hara
*Attorney, Agent, or Firm*—Steven J. Esdale; Lisa B. Esdale; Ryan J. Esdale

[57] ABSTRACT

A nursing table is intended for use during the nursing of a baby and includes a planar surface on which the baby rests. The planar surface has a contoured cutout portion such that the table can wrap around the mother's stomach to enable proper positioning of the baby. The table has adjustable legs that unfold for nursing and fold such that the table can be easily stowed.

8 Claims, 2 Drawing Sheets

METHOD FOR FACILITATING BREAST FEEDING OF A BABY UTILIZING A NURSING TABLE

Priority is claimed under 35 U.S.C. §119(e)(1) based on Provisional Application Ser. No. 60/016,915, filed May 6, 1996 now abandoned.

BACKGROUND OF THE INVENTION

The present invention relates to a table for nursing of a baby and particularly a table to facilitate breast feeding while providing support for the baby and method of using the same.

Heretofore, when a mother breast-fed her baby, she had to cradle the baby in her arms to hold the baby's head at a required height so as to align with her breast. Holding a baby in this manner for any length of time put considerable stress on the mother's body. Thus, a common complaint of breast-feeding mothers is lower back pain. Various devices such as nursing pillows or nursing slings have been designed to hold or support the baby's body during nursing, but all such devices require support from the mother's body in order to achieve a comfortable or normal breast-feeding position. More specifically, nursing pillows are generally supported by the mother's legs while the mother is in a seated position. Additionally, such pillows are not generally height adjustable so that often times comfortable or proper positioning of the baby for nursing purposes is not attained. Examples of such nursing pillows include U.S. Pat. Nos. 5,029,351, 5,092,005 and 5,109,557.

Additionally, feeding trays for enabling the feeding of small children or physically-challenged persons or the like are known, which feeding tables typically have a generally rectangular construction and may have folding legs. However, due to the rectangular construction and the hard surface of the tray, feeding trays are not suitable for supporting a baby and enabling a proper nursing position. An example of a tray with folding legs is U.S. Pat. No. 4,557,200.

SUMMARY OF THE INVENTION

An object of the present invention is to provide a nursing table for enabling breast-feeding of a baby without requiring that the mother's body support the nursing table.

Another object of the present invention is to provide a nursing table with foldable legs so that the table can be carried and stored in an easy manner.

A further object of the present invention is to provide a nursing table having a contoured cutout portion to permit the table to be near and wrapped around a mother so as to enable proper nursing of the baby while the baby is supported on the table.

Another object of the present invention is to provide a nursing table with legs which are adjustable in height so as to enable proper and comfortable positioning for nursing purposes.

These and other objects, features and advantages of the present invention will become more apparent from the following description when taken in conjunction with the accompanying drawings.

DETAILED DESCRIPTION OF THE PRESENTLY PREFERRED EMBODIMENT OF THE INVENTION

Figure 1:
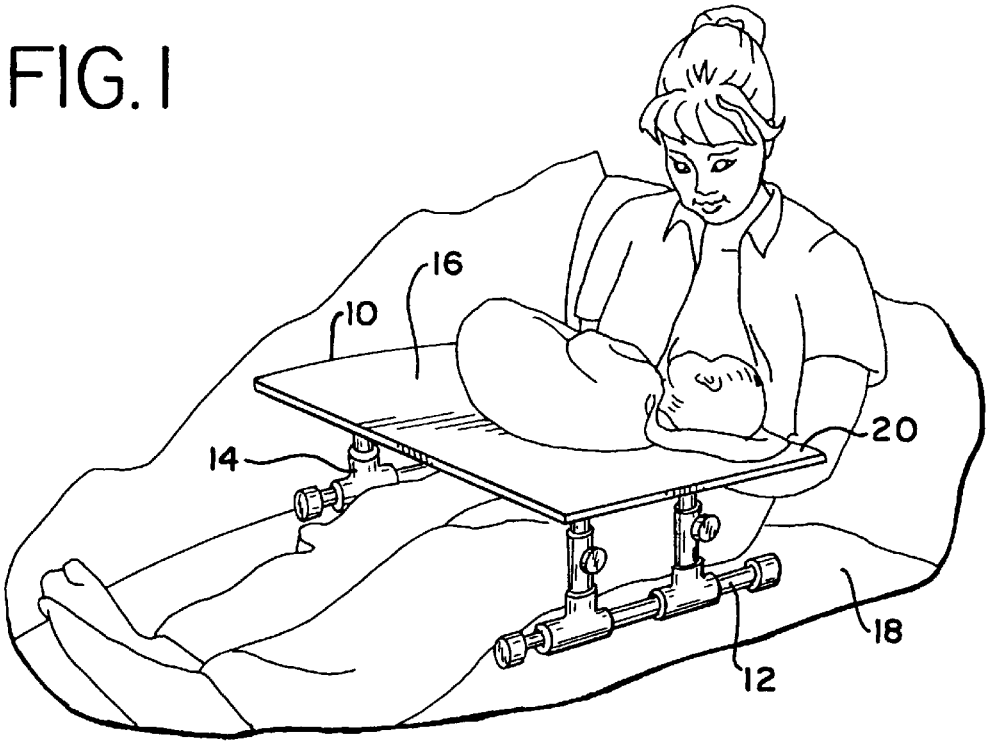
FIG. 1 is a perspective view of the present invention as seen by a person viewing a mother with a baby in the breast-feeding position.

Referring now to the drawings, FIG. 1 illustrates the nursing table 10 of the present invention in the unfolded position in relation to a mother breast-feeding her baby. The unfolded legs 12 and 14 of the table extend from the underside of the surface 16 and are in the unfolded and locked position, with the mother being seated in a comfortable position on a firm surface 18, such as a floor, bed, sofa, or chair. The table is supported directly by the floor, bed, sofa or chair with the unfolded legs 12 and 14 of the nursing table 10 resting on the surface 18. In this manner, the mother can move her legs, for example, without causing movement of the nursing table 10 and consequently movement of the baby. As shown, the nursing table 10 after being placed on the support surface 18 is moved close to the mother, so that the contoured cutout portion 20 (shown more clearly in FIG. 2) of the nursing table 10 wraps around the mother's stomach area. The baby is thereafter placed on the nursing table 10 and properly positioned for nursing purposes. The nursing table surface 16 has a generally rectangular shape with a contoured cutout portion 20 on one edge and is made of wood or other sufficiently rigid material. The surface 16 could be any one of a number of shapes, without varying from the scope of the present invention, as long as the surface has a contoured cutout portion on at least one edge. A cushioned pad such as a foam pad may be provided on at least the top side of the surface 16. The cushioned pad may also be covered with a wipeable or washable material.

Figure 2:
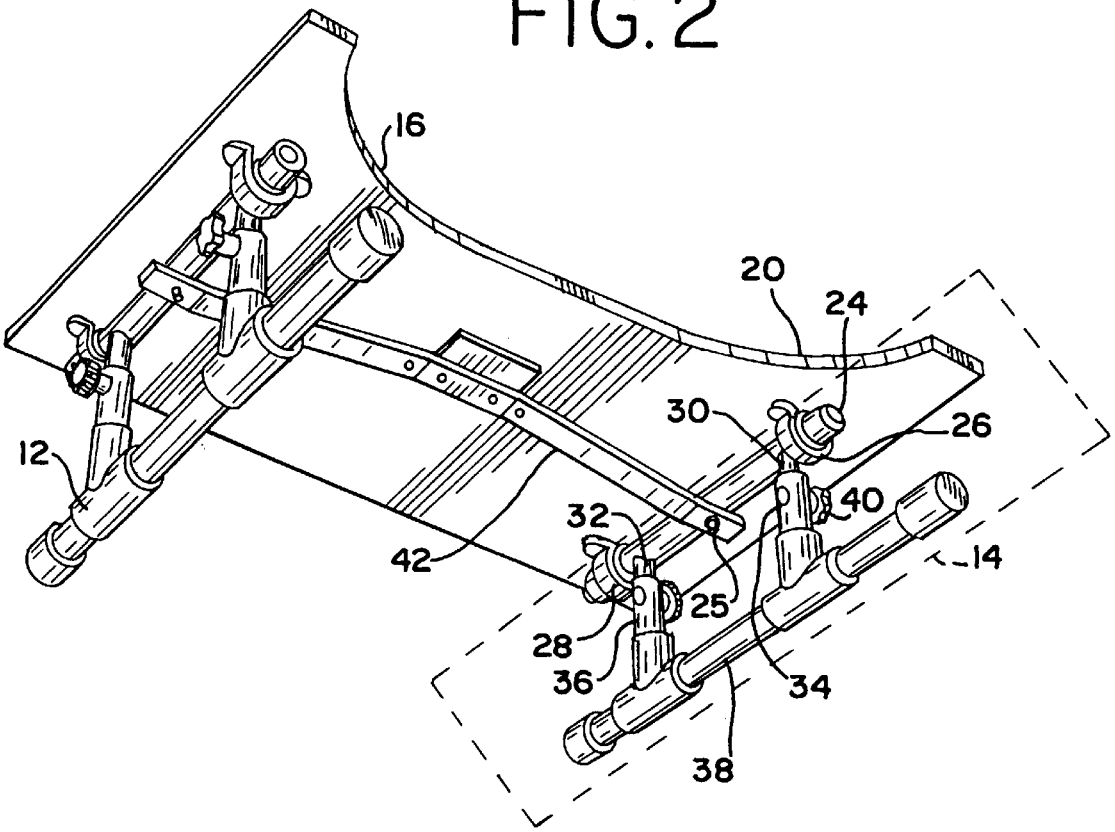
FIG. 2 is a perspective view of the underside of the table showing the legs in the unfolded position.

Referring to FIG. 2, the legs 12 and 14 are identical and are formed generally of tubular members, such as PVC piping. Focusing on leg 14, leg 14 includes a tubular member 24 attached by U-clamps 26 and 28 which are mounted by screws to the underside of the surface 16. The tubular member 24 has a locking pin 25 substantially near its center. Two pipe members 30 and 32 extend from the tubular member 24 by way of t-joints and are connected to pipe members 34 and 36, respectively. The pipe members 34 and 36 both connect, via t-joints, to a support tube 38 which serves as the base of the leg 14. The pipe members 30, 32, 34 and 36 have a plurality of alignable spaced holes. A screw clamp knob 40 or the like extends through the holes of the telescopically alignable pipe members 30, 32, 34 and 36 so as to secure and provide different height adjustments for the leg 14. A spring 42, made of metal or some other similarly strong but flexible material, is fastened to the underside of the surface 16 by screws or the like, such that it overlays the tubular member 24 of leg 14. The spring 42 has a hole which aligns with the locking pin 25 of the tubular member 24 by rotating the leg 14 about the tubular member 24 so that when the leg 14 is in the unfolded position, the locking pin 25 engages the hole thereby locking the leg 14 in the unfolded, upright position. In a similar manner, by lifting the free end of the spring 42 so as to release the locking pin 25 from the hole in the metal spring 42, the leg 14 can be pivoted about the tubular member 24 to the folded position. The tension of the spring 42 and the friction of the U-clamps 26 and 28 against the tubular member 24 keeps the leg 14 securely folded. Leg 12 locks and unlocks and folds and unfolds identically to leg 14.

Figure 3:
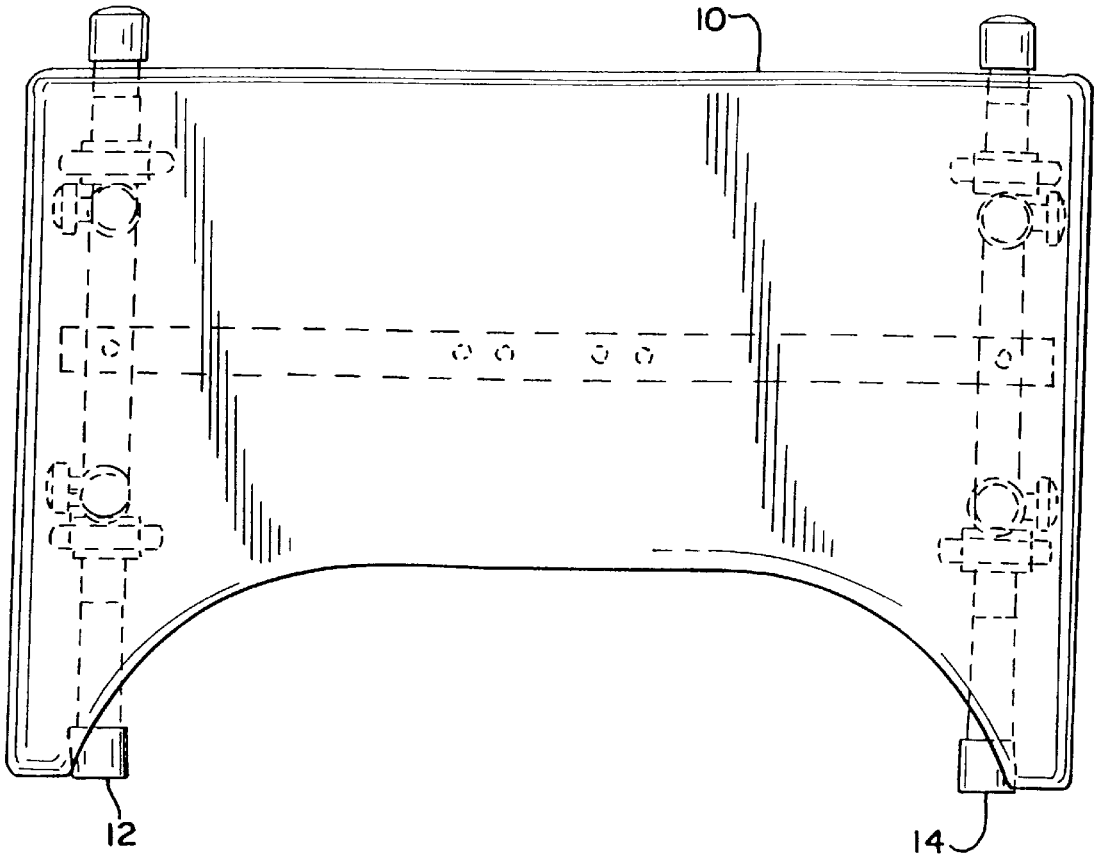
FIG. 3 is a top view of the nursing table of the present invention wherein the legs are in the unfolded position.

FIG. 3 shows the nursing table 10 from the top side with the legs 12 and 14 in the unfolded position.

Figure 4:
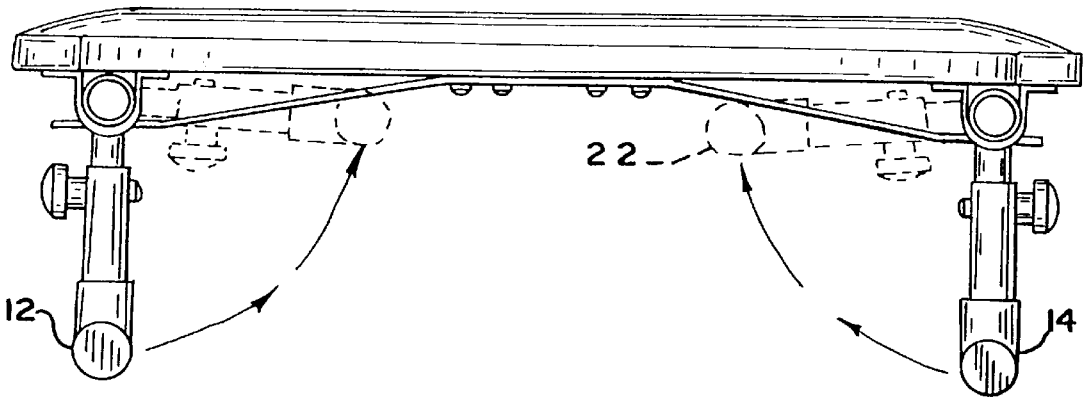
FIG. 4 is a side view of the nursing table of the present invention illustrating the position of the legs in the folded and unfolded positions.

FIG. 4 shows a side view of the nursing table 10 with the legs 12 and 14 being in the unfolded position but also showing the motion of the legs to the final folded position 22. In the folded position 22, the nursing table 10 is configured so as to be inserted into a carrying bag or the like, or easily carried by itself.

In operation, the legs are unfolded and locked in an upright position via the locking pin and metal spring. The mother can position her legs comfortably underneath the surface of the nursing table and will not have to support the baby with her body. The baby is supported by the nursing table which rests on a support surface other than the mother. The mother can therefore maneuver into a proper position for breast-feeding the baby and adjust the height of the nursing table if necessary. Moreover, since the table has a contoured cutout portion, the nursing table can wrap around the mother's stomach for further positioning and support of the baby during breast-feeding. When finished the table can be returned to the folded position by lifting the ends of the spring and rotating the legs about the tubular member to the folded position.

While we have shown and described several embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A method for facilitating breast feeding of a baby by a nurser, comprising the steps of:

arranging a nursing table on a support surface, the nursing table having a generally planar surface with a contoured cutout portion on one edge thereof, and the nursing table having leg portions which are height adjustable;

adjusting the height of the leg portions so that the nursing table is positioned at a height sufficient to provide a comfortable breast feeding position;

positioning the nursing table and the contoured cutout portion in relation to the body of the nurser so that the contoured cutout portion is positioned near and partially wrapped around a portion of a body of the nurser at a height position sufficient to facilitate breast feeding of a baby;

positioning the baby with respect to the generally planar surface of the table so that the baby contacts the table and is supported thereby without requiring the nurser to support the baby or the nursing table; and positioning a nursing breast of the nurser in relation to the mouth of the baby so as to enable breast feeding of the baby.

2. A method according to claim 1, wherein the nurser is in a generally seated position during breast feeding of the baby.

3. A method according to claim 1, further comprising the step of placing a cushioned pad on the planar surface of the table for providing cushioning support for the baby.

4. A method according to claim 3, wherein the cushioning pad has washable or wipeable cover material.

5. A method according to claim 1, wherein ends of the leg portions of the nursing table are supported on a substantially planar firm support surface which supports the nurser so that the nurser is able to move with respect to the table and the baby without causing movement of the nursing table.

6. A method according to claim 1, wherein breast feeding is enabled without stressing of the body of the nurser due to support of the baby or the support surface for the baby.

7. A method according to claim 1, wherein the leg portions are foldable leg portions foldable so as to in a folded state extend substantially parallel to a lower surface of the generally planar surface of the nursing table, and the step of adjusting the height of the leg portions includes unfolding the folded leg portions so that the leg portions extend substantially transversely to the lower surface of generally planar surface of the nursing table and ends of the leg portions are supported on a substantially planar firm support surface which supports the nurser.

8. A method according to claim 7, wherein the leg portions of the nursing table include telescopic members, and the step of adjusting the height of the leg portions includes adjusting the telescopic length of the leg portions.

* * * * *